United States Patent [19]

Drennan

[11] 4,396,196

[45] Aug. 2, 1983

[54] ARROW TIP FOR HUNTING SMALL GAME

[76] Inventor: Randy S. Drennan, Rte. 3, Box 25G, Winnsboro, Tex. 75494

[21] Appl. No.: 412,588

[22] Filed: Aug. 30, 1982

[51] Int. Cl.[3] ..... F41B 5/02

[52] U.S. Cl. ..... 273/420; D22/12

[58] Field of Search ..... 273/419–422; D22/12

[56] References Cited

U.S. PATENT DOCUMENTS

| | | |
|---|---|---|
| 397,950 | 2/1889 | White . |
| 2,620,190 | 12/1952 | Bean . |
| 2,888,264 | 5/1959 | Sharrar et al. . |
| 2,905,470 | 9/1959 | Hoyt, Jr. . |
| 3,012,786 | 12/1961 | Saunders . |
| 3,841,635 | 10/1974 | Wilson . |

OTHER PUBLICATIONS

The Eliminator Blunt Bowhunter Magazine 2–3/78 vol. 7 No. 3 p. 50.

Archer's Bible 1966–1967 p. 80 Kittredge Blackjack Small Game Blunt #RP–500.

*Primary Examiner*—Paul E. Shapiro

*Attorney, Agent, or Firm*—Gerald G. Crutsinger; John F. Booth; James O. Dixon

[57] ABSTRACT

An arrow tip for use in small game hunting being of a generally frustro-conical shape in the forward portion of its body tapering to a diameter approximately the same as that of said arrow shaft at its rearward end, the forward end of the tip having a cupped configuration with a forwardly directed sharp peripheral cutting edge formed by the convergence of linear tapered internal and external walls and having a flat bottom wall recessed from said cutting edge.

7 Claims, 3 Drawing Figures

ARROW TIP FOR HUNTING SMALL GAME

BACKGROUND OF INVENTION

This invention relates to arrow tips and more particularly to arrow tips designed to produce impact shock as well as a lethal wound in small game struck by it.

Most arrow tips for game hunting are designed with larger game, such as deer, antelope or turkeys and the like in mind. Those tips are designed to produce fatal or at least incapacitating wounds through deep penetration and/or wide laceration so that the game may be brought to ground and bagged as quickly and humanely as possible. Such arrow tips tend to excessively disrupt the physical configuration of small game struck by them thus reducing its value as food or as a trophy mount. Additional disfiguration may be caused by tips having barbs or wide longitudinal cutting blades. Arrow tips of this type are exemplified by those disclosed in U.S. Pat. Nos. 2,620,190 to Dean and 2,888,264 to Sharrar et al.

Arrow tips have been especially designed for use in hunting small game. The arrow head of the Hoyt, Jr. U.S. Pat. No. 2,905,470 is designed with a point for penetration but with a blunted "shoulder" area to slow the penetration and produce an impact shock from dissipation of the kinetic energy of the arrow. This tip, as it is designed to do, produces excessive physical damage for the sake of a sure kill and recovery of the game. In contrast, the Saunders arrow tip of U.S. Pat. No. 3,012,786 is designed to produce shock impact almost exclusively with little if any penetration of the animal's hide. Thus, if the game is not retrieved within the period of time before the shock wears off, or the animal regains consciousness, it will almost surely escape.

The arrow tip of the present invention is designed to deliver an incapacitating shock impact when it strikes small game and at the same time to produce a profusely bleeding wound which will take lethal effect on the game within the time ordinarily required for the impact shock to wear off.

The arrow tip of the present invention is of a generally conical shape, having a cupped end with a circumferential cutting edge formed to a knife-like sharpness. Thus, an animal struck by the tip is prevented from escaping because it is initially stunned by the impact and immobolized long enough for the wound resulting from the cutting edge to take lethal effect.

It is an object then of the present invention to provide an arrow tip which is more effective against small game than previous designs.

It is another object to provide an arrow tip for use in hunting which is effective to bring down small game without undue damage to edible portions.

It is a further object to provide an arrow tip having less tendency to glance from the quarry.

It is a still further object to provide an arrow tip helpful in preventing loss of arrows when shot in grassy, bushy or sandy areas.

BRIEF DESCRIPTION OF THE DRAWING

These and other objects and advantages of the present invention will become apparent from the following detailed description when read with reference to the accompanying drawing wherein.

DETAILED DESCRIPTION

Figure 1:
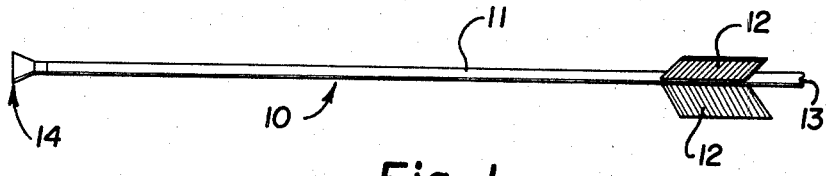
FIG. 1 is a side view of an arrow equipped with the small game hunting tip of the present invention.
Figure 2:
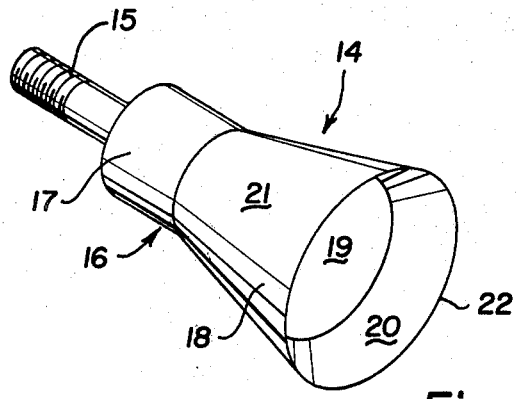
FIG. 2 is a perspective view of the arrow tip of the present invention from a front angle.

Referring now to FIG. 1, an arrow 10 comprises a shaft 11 which ordinarily is of light metal or straight grained wood. Shaft 11 is equipped near one end with guide veins or fins 12 which often are segments of feather. Shaft 11 has the usual transverse slot or notch 13 at its rearward end for fitting the arrow onto the string of the bow. The other end of the shaft 11 has affixed to it a tip 14. The tip 14 may be attached to shaft 11 in any conventional manner. A standard externally threaded mounting shank 15 is illustrated on the tips of FIGS. 2 and 3.

The arrow tip 14 further comprises a main body 16 having a cylindrical region 17 and a frustro-conical section 18. The forward end of section 18 is cupped having a flat bottom wall 19 and a circular slanted interior sidewall 20. Interior sidewall 20 meets the circular slanted exterior sidewall 21 to form a rim or edge 22 of knife-like sharpness.

The absolute and relative sizes of the various parts of the arrow tip 14 are not critical. However, it has been found advantageous for the cylindrical region 17 to be approximately 5/16th of an inch in diameter or about the same size as the shaft 11 of the arrow 10. The conical section 18 may flare to a diameter of about 9/16th of an inch at the cutting edge with the cupped end of the tip 14 having a depth of about ⅛th inch from the edge 22 to bottom wall 19. External sidewall 21 slants at about a 15° angle from the sidewall of section 17 and internal sidewall slants at an angle of about 35° from the sidewall of section 17.

Figure 3:
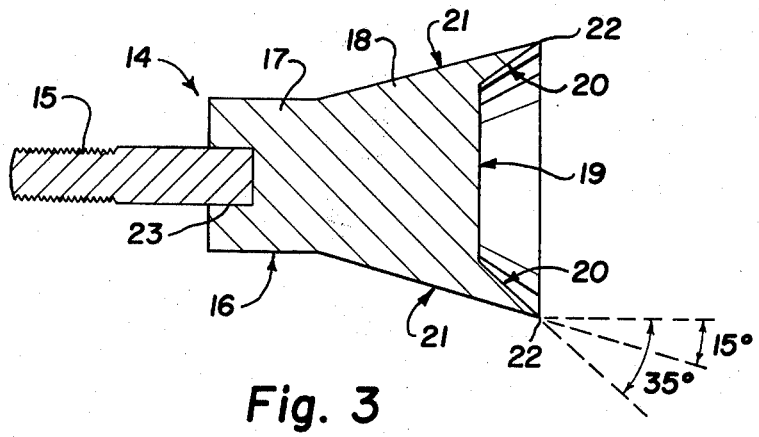
FIG. 3 is a side elevation section of the arrow tip of FIG. 2.

The arrow tip of the present invention may be made of any appropriate material but quality tempered steel is the material preferred to form the cutting edge 22. As illustrated in FIG. 3, the main body of the tip may be of one material such as tempered steel and the mounting shank 15 of another such as aluminum. The mounting shank 15 may extend into a drilled hole 23 in the body 16 and be secured therein. Alternately the tip 14 may be formed of a single material throughout or the forward portion only of the main body may be formed of a material capable of taking a fine cutting edge 22 with the remainder of the tip body and mounting shank formed materials. Tips with cutting edges 22 formed of tempered steel have been found to be long lasting and to retain their sharp edge well in field practice as well as in hunting. It has been found that after more than a thousand shots of a tip into sand, grass, small bushes and stumps, the steel cutting edge sustained little or no visible damage. When a cutting edge does sustain damage, it can usually be resharpened and its useful life thereby considerably extended.

The arrow tip of the present invention has been found quite effective in stopping the small game immediately when hit. The sharp circumferential edge produces a profusely bleeding wound which is quickly lethally effective. The tip has been found not to interfere with the true flight of the arrow. However, when the target is missed, as will happen to the best of bowmen, the tip of the present invention tends to prevent penetration so deeply into grass or other ground cover that the arrow is obscured and lost. The tip also helps prevent arrow skip and buried arrows.

Thus, there has been disclosed a new arrow tip for small game hunting. Many changes and modifications still within the spirit and scope of the teachings herein will occur to those skilled in the art and, therefore, this invention is to be limited only as set forth in the following claims.

What is claimed is:

1. An arrow tip adapted to be secured to the end of an arrow shaft, said tip being of a generally frustro-conical shape in the forward portion of its body, tapering to a diameter approximately the same as that of said arrow shaft at the rearward portion of its body, the forward end of said tip having a cupped configuration with a forwardly directed sharp peripheral cutting edge and an essentially flat bottom wall recessed from said cutting edge.

2. The arrow tip of claim 1 wherein said cupped configuration is formed by a linear inwardly tapering wall from said cutting edge to said rear wall.

3. The arrow tip of claim 2 wherein said bottom wall is recessed approximately 1/8th inch from said cutting edge, said cutting edge is about 9/16th inch in diameter and said rearward end is about 5/16th inch in diameter.

4. The arrow tip of any one of claims 1–3 wherein said cutting edge is of tempered steel.

5. The arrow tip of claim 4 which is adapted to be secured to the end of an arrow shaft by means of an externally threaded mounting shank extending rearwardly from the main body of said tip.

6. The tip as defined in claim 5 wherein said mounting shank is of a material different from the material of said cutting edge.

7. An arrow tip having a main body of a generally frustro conical shape with its forward end having a cupped configuration with a substantially flat rear wall, said cupped configuration having a forwardly directed sharp peripheral cutting edge of tempered steel about 9/16ths inch in diameter, said cutting edge being formed at the intersection of a linear tapering external wall of said tip with a linear tapering internal wall of said cupped configuration terminating at said flat rear wall about 1/8th inch rearward of said cutting edge, said tip being adapted to be secured to the end of an arrow shaft by means of an externally threaded mounting shank extending rearwardly from said main body, said mounting shank being of a material different from said cutting edge.

* * * * *